US006220347B1

(12) United States Patent
Head

(10) Patent No.: US 6,220,347 B1
(45) Date of Patent: Apr. 24, 2001

(54) BORE HOLE CLEARING

(76) Inventor: Philip Head, 178 Brent Crescent, London, NW10 7XR (GB)

( * ) Notice: Subject to any disclaimer, the term of this patent is extended or adjusted under 35 U.S.C. 154(b) by 0 days.

(21) Appl. No.: 09/335,978

(22) Filed: Jun. 18, 1999

(30) Foreign Application Priority Data

Jun. 20, 1998 (GB) ..... 9813404

(51) Int. Cl.[7] ..... F21B 31/00; F21B 37/00; F21B 43/00

(52) U.S. Cl. ..... 166/105.3; 166/301; 166/311

(58) Field of Search ..... 166/105.1, 105.3, 166/301, 311, 312

(56) References Cited

U.S. PATENT DOCUMENTS 5,230,388 * 7/1993 Cherrington ..... 175/53
6,059,030 * 5/2000 Celestine ..... 166/105.1

* cited by examiner

*Primary Examiner*—David Bagnell
*Assistant Examiner*—Jennifer Hawkins
(74) *Attorney, Agent, or Firm*—Herbert Dubno

(57) ABSTRACT

An apparatus for removing debris from a bore hole, comprising a housing, and a cylindrical electric motor coupled coaxially to a direct drive pump. The housing includes a debris entry port into which the debris is induced to flow into the housing, and the inside of the housing is maintained at a pressure which is lower than the outside pressure. The electric motor has a central bore through which material pumped by the pump can pass. The apparatus includes a head rotatable by the motor which engages the debris deposits in the bore hole. Where the pump is a direct drive worm pump, the head may be directly attached to the worm of the pump. In one embodiment, the housing extends along the whole length of the motor and pump, with the apparatus including a port settable to allow debris to be pumped into the housing from either end. Alternatively, a debris collection means may be included for effectively isolating any debris pumped by the pump from the bore hole. This debris collection means may be a pipe extending from the bore hole head to the motor and pump, or it may be a compartment attached to the motor and having a filter through which fluid may pass but which traps debris.

7 Claims, 2 Drawing Sheets

BORE HOLE CLEARING

FIELD OF THE INVENTION

The present invention relates to the clearing of tubes and bores, and particularly oil well and like bore holes.

BACKGROUND OF THE INVENTION

In the drilling and operation of oil wells, a considerable amount of apparatus is often placed down the bore holes. (Although the term "down" is used, some bore holes may have considerable lengths which are far from vertical, and may be substantially horizontal). There can be considerable flows of material trough the bore hole, such as mud used for driving drill heads, and wires or pipes may be passed through the bore hole. Further, the bore hole may pass through friable strata which may be eroded. All these matters can result in the accumulation of detritus, which will here be termed "mud", in the bore hole; its consistency may of course vary widely. The mud may be deposited along the length of the bore hole, or on top of a piece of apparatus in the bore table.

It is often desirable or necessary to clear a bore hole of such mud. Present techniques for such clearing are relatively primitive. Some form of scraper or similar mechanical device may be lowered into the bore hole in an attempt to loosen compacted mud, and some form of bucket or similar mechanical device may similarly be lowered into the bore hole in an attempt to capture particles or pieces of mud and pull them up to the surface.

OBJECT OF THE INVENTION

The general object of the present invention is to provide an improved technique for clearing bore holes of mud.

SUMMARY OF THE INVENTION

According to one aspect, the invention comprises using a electric motor coupled to a pump to remove mud from a bore hole.

According to another aspect, the invention provides apparatus for clearing a bore hole or the like of debris, comprising a housing, and a cylindrical electric motor coupled coaxially to a direct drive pump, the housing including a debris entry port into which the debris is induced to flow into the housing and wherein the inside of the housing is maintained at an inside pressure which is lower than the outside pressure.

Preferably the apparatus includes debris collection means for effectively isolating any debris pumped by the pump from the bore hole.

The electric motor preferably has a central passage through which material pumped by the pump can pass.

The apparatus preferably has a head rotatable by the motor for engagement with debris deposits in the bore hole. The head may be directly attached to the worm of the pump where the pump is a direct drive worm pump, or the head may comprise a tubular housing around the motor and/or pump. In the latter case, the housing may extend along the whole length of the motor and pump, with the apparatus including a port settable to allow debris to be pumped into the housing from either end.

The debris collection means may be a compartment attached to the motor and having a filter through which fluid may pass but which traps debris. Alternatively, the debris collection means may be a pipe (of the type known as a coiled pipe) extending from the bore hole head to the motor and pump.

BRIEF DESCRIPTION OF THE DRAWING

Two bore hole mud clearing apparatuses embodying the invention will now be described, by way of example and not intended to be limiting, with reference to the drawing, in which.

SPECIFIC DESCRIPTION

Figure 1:
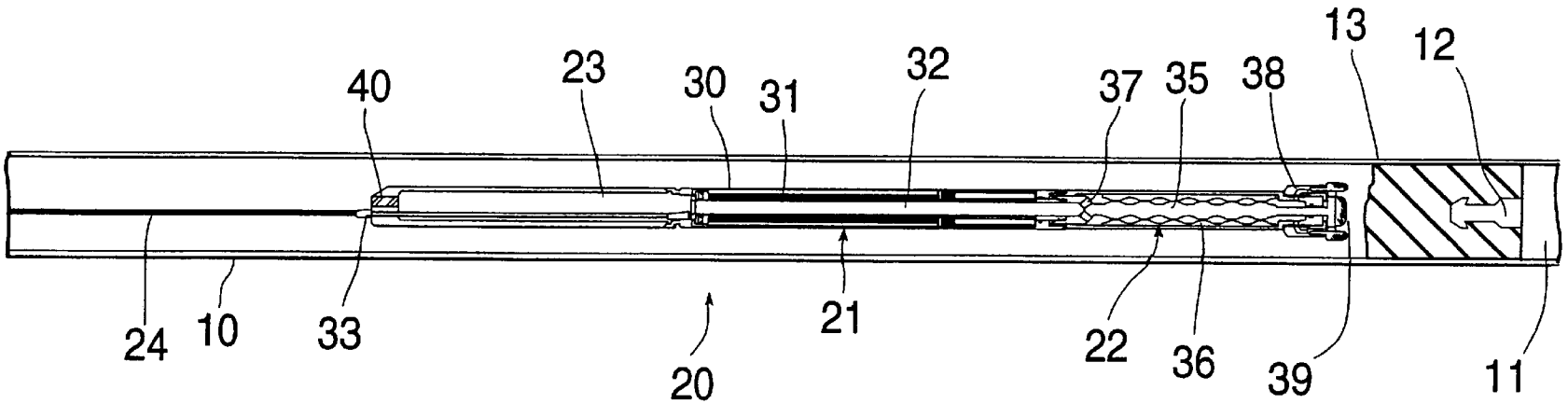
FIG. 1 is a longitudinal section through the first apparatus.

Referring to FIG. 1, this shows a bore hole 10 in which a piece of apparatus 11 has become detached. This piece of apparatus has a coupling element or fish 12, which is intended to allow the apparatus 11 to be grasped and so pulled out of the bore hole. This fish has become covered by mud 13, and it is necessary to remove this mud before the fish can be reached and grasped.

The bore hole 10 also contains a bore hole mud clearing apparatus 20, which comprises three main components; a motor 21, a pump 22, and a mud collection chamber 23. This apparatus is linked to the bore hole head by means of a wire 24, which supports the apparatus mechanically (so that it can be pulled out of the bore hole) and also carries an electric power cable to the apparatus.

The motor 21 is a cylindrical electric motor comprising an outer stator 30 and an inner rotor 31 which has a cylindrical passage 32 along its length. The motor is powered from the power carried through the wire 24 via a connector 33.

The pump 22 is a direct drive worm pump. A worm 35 is connected to the motor rotor 32, and a housing 36 is connected to the motor stator 31. Ports 37 provide a passage between the pump and the bore 32 through the motor. A head housing 38 is mounted on the end of the pump housing 36, and a head rotor 39 is mounted on the end of the pump worm 35.

The other end of the motor bore 32 communicates directly with the mud collection chamber 23, which has a filter 40 which retains mud but allows liquid to escape.

In use, the motor 21 drives the pump 22 to suck up the mud 13 (the whole of the bore being filled with a suitable liquid acting as a carrier). The head 39 rotates against the mud, helping to loosen pieces from the body of mud. The pieces of mud sucked up are passed through the bore 32 through the motor and are collected in the mud collection chamber 23.

Figure 2:
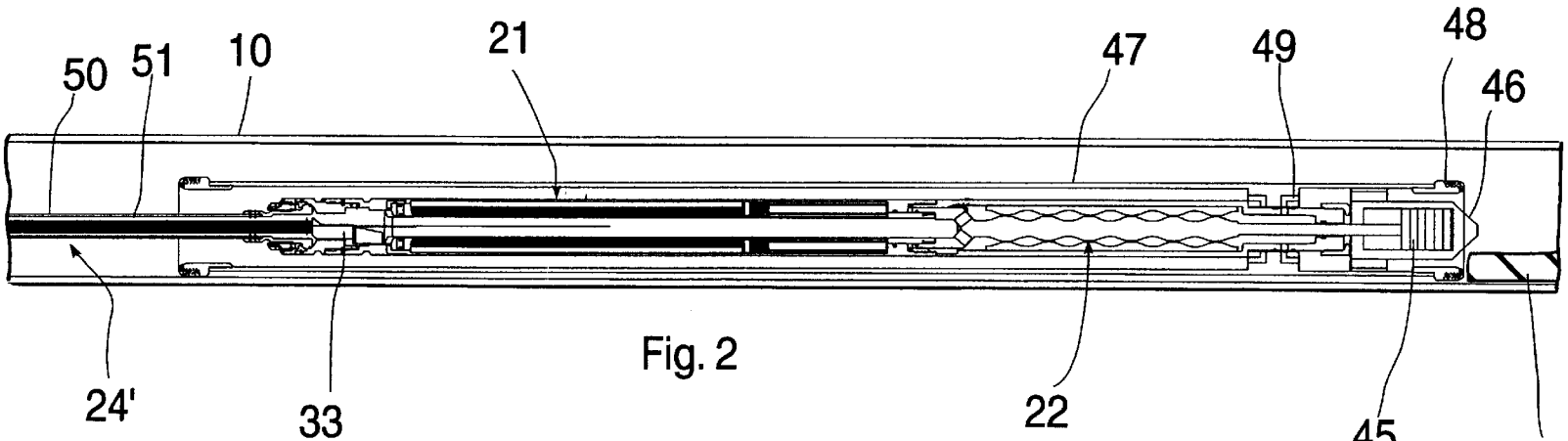
FIG. 2 is a longitudinal section through the second apparatus.

Referring now to FIG. 2, a second bore hole mud clearing apparatus is shown. This apparatus is connected to the bore hole head by means of a coiled tube 24'(so termed because it is a tube and the part not in the hole is retained in the form of a large coil at the bore hole head). This coiled tube 24' is hollow, and carries the electric power cable to the apparatus.

As before, this apparatus comprises a motor 21 and a pump 22. The motor and pump are, in this apparatus, enclosed within a tubular housing 47, which has a nose 46 attached to its front end. The pump rotor has attached to it a coupling element 45 which is contained within the housing nose 46 as shown. This nose is filled with viscous oil, so that the tubular housing will rotate with the motor and pump, though at slower speed. The housing terminates in an annular head 48, which rotates against the mud, helping to loosen pieces from the body of mud. The pieces of mud are sucked away from the mass of mud 13 through the tubular housing 47, around the nose 46 and through ports 49 into the pump.

From the pump 22, the sucked up fluid with pieces of mud are passed through the passage 32 of the motor 21. At the other end of the motor, the passage is connected to the center of the coiled tube 24', through which the sucked up fluid with the pieces of mud passes to the bore hole head. The tube 24' is made up of inner and outer tubes 51 and 50 as shown.

Figure 2A:
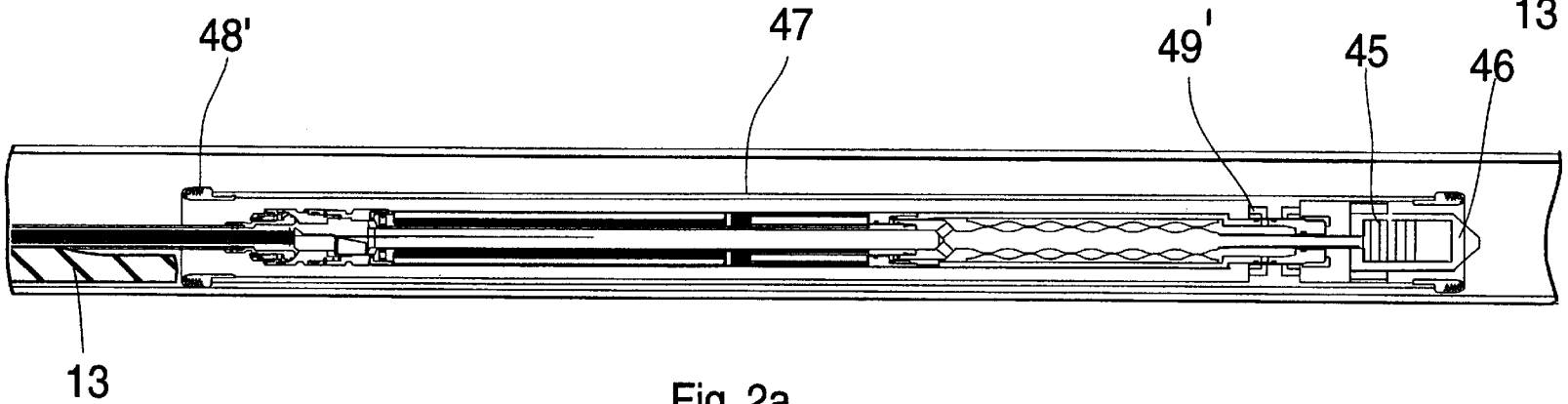
FIG. 2A is a longitudinal section through the second apparatus in a second configuration.

In the FIG. 2 configuration, the apparatus is being pushed forward along the bore hole to clear mud from in front of it. FIG. 2A shows an alternative configuration of the apparatus, in which it has been passed down the bore hole and is being pulled back out. In this configuration, it clears mud lying between it and the well head.

The position of the motor and pump relative to the tubular housing 47 is determined by the relationship between the nose 46 at the front end of the housing and the coupling element 45 attached to the pump rotor. When the apparatus is being pushed into the bore hole, the relative position of these elements 45 and 46 is as shown in FIG. 2. When the apparatus is being pulled out of the bore hole, the coupling element 45 moves to the other end of the interior of the nose 46, as shown in FIG. 2A. This results in some ports 49 being closed and other ports 49' being opened.

The pump now sucks from the other end of the housing 47 (the left hand end as seen in the drawings). The housing 47 rotates in the same way in both configurations of the apparatus, and has a second annular head 48' at its left hand end. In the FIG. 2A configuration, this head 48' rotates against the mud in the bore above the apparatus, ie between the apparatus and the bore hole head. As a result, the apparatus acts to clear mud from the bore as it is being drawn out of the bore hole, as well as when it being lowered into the bore hole (ie in the FIG. 2 configuration).

The rotating nose 46 may also be provided with a helical auger, so that the as the nose rotates, the auger moves the mud, assisting the action of the pump.

Referring back to the embodiment shown in FIG. 1, the apparatus may be hung upon a length of coiled tubing rather than the wire 24, that is, in a similar fashion to the embodiment shown in FIG. 2. The filter 40 may be dispensed with, and the outlet instead connected to the coiled tubing. Provided that the coiled tubing and the power cable are chosen so that there is sufficient bore available, the mud and debris may then be pumped to the surface through the coiled tubing.

Alternative embodiments using the principles disclosed will suggest themselves to those skilled in the art, and it is intended that such alternatives are included within the scope of the invention, the scope of the invention being limited only by the claims.

What is claimed is:

1. An apparatus for clearing debris from a bore hole of a well, comprising a cylindrical housing and a cylindrical electric motor in said housing and coupled coaxially to a direct drive pump below said motor extending axially in said bore hole and having a rotor, the housing including a debris entry port into which the debris is induced to flow into the housing and wherein the inside of the housing is maintained at a pressure which is lower than the outside pressure, an electric cable extending down through said bore hole to said motor for energizing same, and a debris loosening head on said rotor below said housing for loosening debris in said well.

2. The apparatus according to claim 1 wherein the apparatus includes debris collection means for effectively isolating any debris pumped by the pump from the bore hole.

3. The apparatus according to claim 1 wherein the electric motor has a central bore through which debris pumped by the pump can pass.

4. The apparatus according to claim 1 wherein the pump is a direct drive worm pump, and the head is directly attached to the worm of the pump.

5. The apparatus according to claim 1 wherein the housing extends from said head around said pump.

6. The apparatus according to claim 1 wherein the debris collection means is a compartment attached to the motor and having a filter through which fluid may pass but which traps debris.

7. The apparatus according to claim 1 wherein the debris collection means is a pipe extending from an upper end of the bore hole to the motor and pump.

* * * * *